United States Patent [19]

Osborne

[11] Patent Number: 4,651,485

[45] Date of Patent: Mar. 24, 1987

[54] INTERLOCKING BUILDING BLOCK SYSTEM

[76] Inventor: Ronald P. Osborne, 16510 Pilgrims Cir., Spring, Tex. 77379

[21] Appl. No.: 774,960

[22] Filed: Sep. 11, 1985

[51] Int. Cl.[4] ..... E04C 1/10

[52] U.S. Cl. ..... 52/284; 52/220; 52/591; 52/594

[58] Field of Search ..... 52/591, 594, 284, 220

[56] References Cited

U.S. PATENT DOCUMENTS

| | | | |
|---|---|---|---|
| 1,516,473 | 11/1924 | Davis | 52/591 |
| 3,416,276 | 12/1968 | Caputo et al. | 52/293 |
| 3,534,518 | 10/1970 | Zagray | 52/258 X |
| 3,818,656 | 6/1974 | Vigliotti | 52/591 X |
| 3,956,862 | 5/1976 | Alexandre, Jr. | 52/590 X |
| 4,314,431 | 2/1982 | Rabassa | 52/259 |

FOREIGN PATENT DOCUMENTS

| | | | |
|---|---|---|---|
| 207382 | 4/1957 | Australia | 52/594 |
| 444260 | 8/1912 | France | 52/594 |
| 1030751 | 3/1953 | France | 52/591 |
| 1233090 | 5/1960 | France | 52/513 |
| 446904 | 3/1949 | Italy | 52/594 |
| 506230 | 12/1954 | Italy | 52/594 |

*Primary Examiner*—Alfred C. Perham
*Attorney, Agent, or Firm*—Neal J. Mosely

[57] ABSTRACT

An interlocking building block system comprises a plurality of rectangular building blocks, each with longitudinal side surfaces, upper and lower longitudinal faces, and vertical end walls normal to the side surfaces and longitudinal faces. The upper longitudinal face of the blocks has a central longitudinal arcuate rib and a pair of transverse spaced arcuate ribs thereon. The transverse ribs extend laterally from the longitudinal rib to one of the side surfaces. Corresponding longitudinal and lateral transverse concave arcuate recesses in the lower longitudinal face mate with the ribs of an adjacent block when assembled. A pair of spaced vertical slots extend through the block inwardly of each end wall opposite to the transverse ribs and terminate tangentially to the longitudinal rib. One block may be placed on the intersection of two abutting blocks with one transverse rib from each lower block received in each transverse recess of the upper block and one vertical slot from each lower block in vertical alignment with the slots of the upper block. Corner blocks have a single vertical slot and a third transverse rib and recess opposite and coextensive with one of the pair of transverse ribs and recesses formed on the longitudinal faces.

9 Claims, 13 Drawing Figures

INTERLOCKING BUILDING BLOCK SYSTEM

BACKGROUND OF THE INVENTION

1. Field of the Invention

This invention relates to mortarless interlocking building blocks for assembly in longitudinally staggered rows, and more particularly to a rectangularly shaped building block with a system of interlocking ribs and recesses.

2. Brief Description of the Prior Art

The laying of building blocks is a major labor cost in buildng construction, and there is a continuing need for building blocks which may be economically assembled to produce energy efficient, strong and durable structures. There are several patents disclosing building blocks which address this problem.

Rabassa, U.S. Pat. No. 4,314,431 discloses a generally rectangular mortarless interlocking building block having a single trapezoidal protrusion along the center of the top side, and a single trapezoidal slot along the center of the bottom side capable of receiving the protrusion and leaving a longitudinal space above the protrusion. A longitudinal opening extends through the block between the slot and protrusion that acts as a thermal and acoustic insulator and may be also be used to route conduit and wiring through it.

Caputo et al, U.S. Pat. No. 3,416,276 discloses a wall constructed of generally rectangular cored building blocks having a tongue on the top end and a groove on the bottom end. The blocks are laid with the larger dimensioned side surfaces vertical and the ends with the tongues and grooves horizontal. The blocks laid in this manner eliminates one course of blocks for every two courses as compared with conventional rectangular block wall construction.

Zagray, U.S. Pat. No. 3,534,518 discloses an interlocking rectangular building block construction having a pair of longitudinal ribs with flat top surfaces along the upper longitudinal face near the opposite sides of the block and a correspondingly shaped longitudinal recess is formed in the lower longitudinal face. A longitudinal groove having downwardly and inwardly converging side walls and a flat bottom wall is centrally located between the ribs, and a corresponding groove is located in the recess. A central vertical aperture extends through the block midway between the vertical end faces and communicates with the upper and lower grooves. Oppositely disposed, transverse, narrow flat extensions of the apparatus terminate near the opposite side of the block.

The prior art in general, and these patents in particular, do not disclose the system of interlocking rectangular building block of novel construction which comprises this invention.

SUMMARY OF THE INVENTION

It is therefore an object of the present invention to provide a set of interlocking building blocks which may be easily assembled in longitudinal staggered rows to form a solid and sturdy wall structure.

Another object of this invention is to provide an efficient system of interlocking building blocks which will substantially reduce labor costs by eliminating the need to employ highly skilled labor in the construction of walls.

Another object of this invention is to provide a wall structure of interlocking blocks having a series of vertical passages which may be conveniently and advantageously utilized for structural members, plumbing, wiring, conduit, air circulation or ducts, and various other building structure components.

Another object of this invention is to provide a building block of improved design and construction which will substantially reduce labor costs by eliminating the need to employ highly skilled labor in the construction of walls.

Another object of this invention is to provide a building block having a novel system of ribs and recesses in selected faces thereof which will substantially reduce labor costs by eliminating the need to employ highly skilled labor in the construction of walls.

Another object of this invention is to provide a building block having a novel system of ribs and recesses in selected faces thereof including a series of vertical passages which may be conveniently and advantageously utilized for structural members, plumbing, wiring, conduit, air circulation or ducts, and various other building structure components.

Other objects of the invention will become apparent from time to time throughout the specification and claims as hereinafter related.

The above noted objects and other objects of the invention are accomplished by an interlocking building block system comprising a plurality of rectangular building blocks, each with longitudinal side surfaces, upper and lower longitudinal faces, and vertical end walls normal to the side surfaces and longitudinal faces. The upper longitudinal face of the blocks has a central longitudinal arcuate rib and a pair of transverse spaced arcuate ribs thereon. The transverse ribs extend laterally from the longitudinal rib to one of the side surfaces. Corresponding longitudinal and lateral transverse concave arcuate recesses in the lower longitudinal face mate with the ribs of an adjacent block when assembled. A pair of spaced vertical slots extend through the block inwardly of each end wall opposite to the transverse ribs and terminate tangentially to the longitudinal rib. One block may be placed on the intersection of two abutting blocks with one transverse rib from each lower block received in each transverse recess of the upper block and one vertical slot from each lowrer block in vertical alignment with the slots of the upper block. Corner blocks have a single vertical slot and a third transverse rib and recess opposite to and coextensive with one of the pair of transverse ribs and recesses formed on the longitudinal faces.

DESCRIPTION OF THE PREFERRED EMBODIMENT

Figure 1:
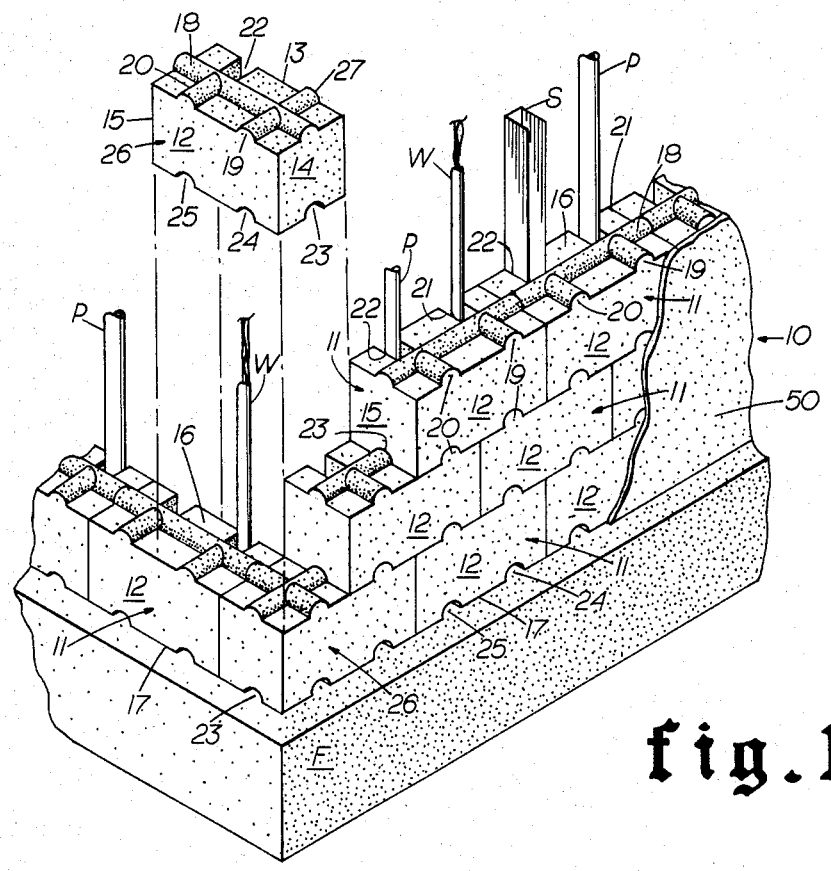
FIG. 1 is a partial isometric view of a wall constructed with building blocks in accordance with the present invention, viewed from the outside.
Figure 2:
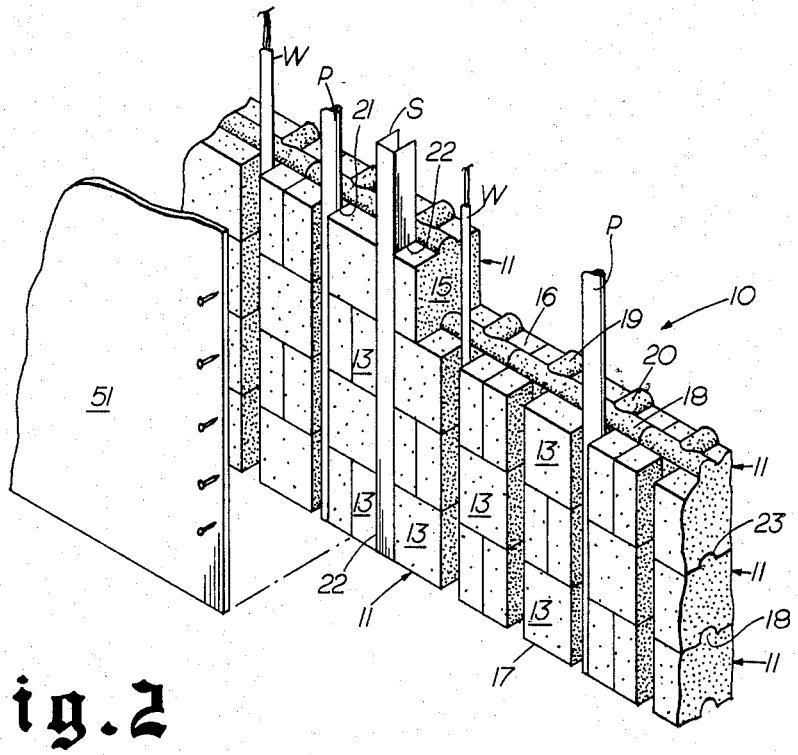
FIG. 2 is a partial isometric view of a wall constructed with building blocks in accordance with the present invention, viewed from the inside.
Figure 3:
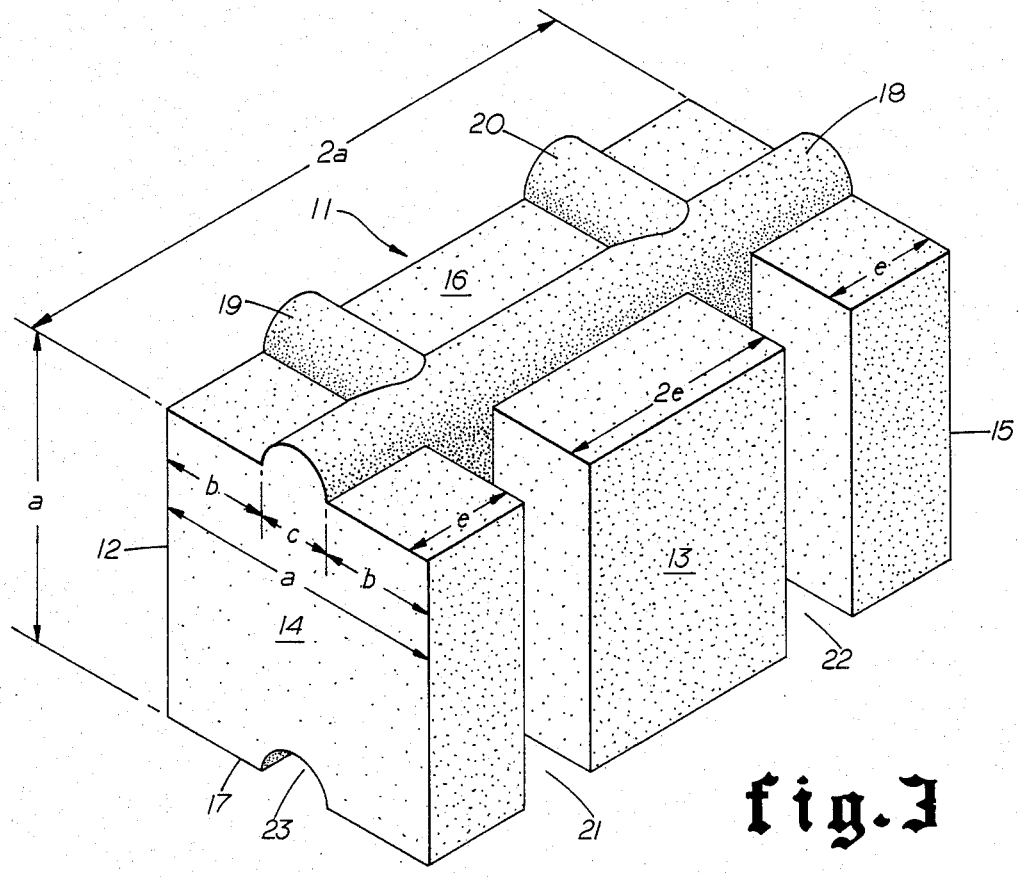
FIG. 3 is an isometric view of a preferred stretcher block.
Figure 4:
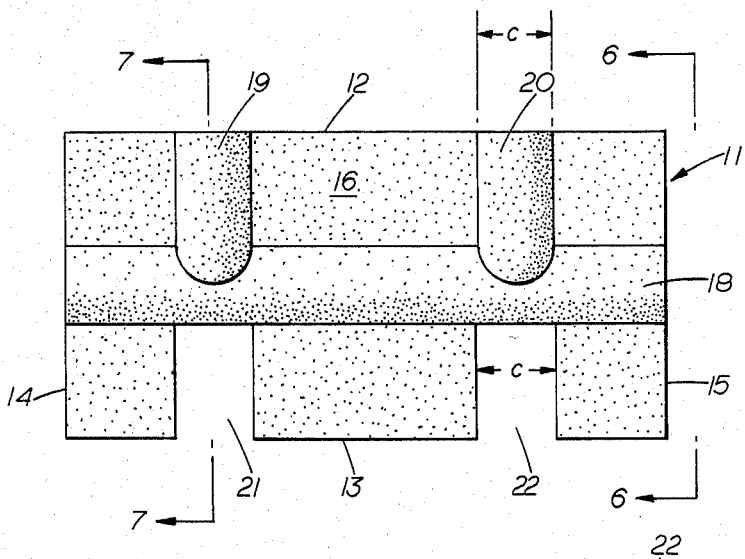
FIG. 4 is a top plan view of the stretcher block.
Figure 5:
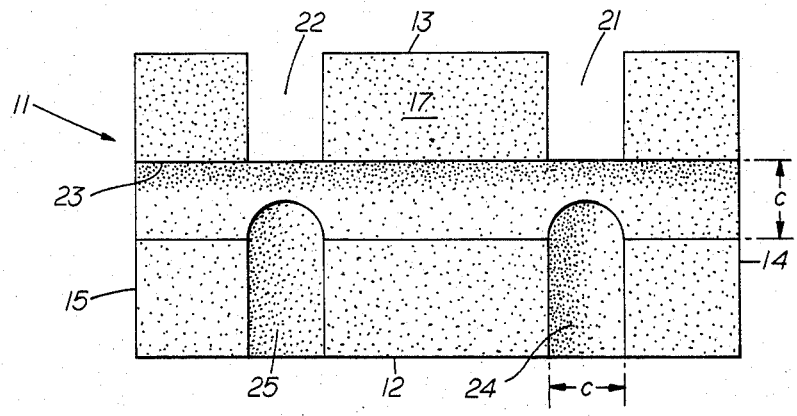
FIG. 5 is a bottom plan view of the stretcher block.

Referring to the drawings by numerals of reference, and particularly to FIGS. 1 and 2, a wall 10 is shown constructed of a plurality of courses of building blocks in accordance with the present invention. A stretcher block is indicated generally by the numeral 11, and shown in detail in FIGS. 3 through 7. The block 11 is rectangular and preferably manufactured in sizes according to conventional concrete or cement building block standards, such as 8"×16" for full size blocks or 8"×8" for half size, filler blocks. The end of block 11 is a square of dimension "a" while the length of the block is "2*a*". The block 11 has substantially parallel opposed side surfaces 12 and 13, opposed end walls 14 and 15, and substantially parallel opposed upper and lower faces 16 and 17 respectively.

The longitudinal upper face 16 of the block 11 has a longitudinal, protruding arcuate rib 18 centrally between the side surfaces 12 and 13, and a pair of transverse, longitudinally spaced, protruding arcuate ribs 19 and 20 inwardly of the end walls 14 and 15. The transverse ribs 19 and 20 are the same height as the longitudinal rib 18 and extend laterally from the rib 18 to the longitudinal side surface 12.

Block 11 has a pair of longitudinally spaced, vertical slots 21 and 22 having parallel side walls inwardly of the end walls 14 and 15 extending from top to bottom therethrough. The slots 21 and 22 extend inwardly from the other side surface 13 terminating tangentially at the rib 18 and are in axial alignment with and having the same width as the transverse ribs 19 and 20.

The longitudinal lower face 17 of the block 11 has a longitudinal, arcuate recess 23 centrally between the side surfaces 12 and 13, and a pair of transverse, longitudinally spaced, protruding arcuate recesses 24 and 25 inwardly of the end walls 14 and 15. The transverse recesses 24 and 25 are the same depth as the longitudinal recess 23 and extend laterally from the recess 23 to the side surface 12. The longitudinal and transverse recesses are spaced and of sufficient size to receive the longitudinal and transverse ribs of similar blocks when a wall is constructed therefrom.

The longitudinal rib 18 is centrally positioned and has a width at its base of "c" which is the same as the width of slots 21 and 22. The distance "b" from the edges of the rib 18 to the side walls 12 and 13 is the same as the dimension "e" of the edge of the block from end face 14 to slot 21 or the end face 15 to the slot 22. The dimension of the edge of the block between the slots 21 and 22 is "2*e*". This spacing is important to the assembly of a wall from the blocks.

The spacing of the slots and recesses is symmetrical about the central vertical axis of the block 11 whereby one block may be placed atop the intersection of two abutting blocks with one transverse rib from each lower block received in each transverse recess of the upper block and one vertical slot from each lower block in vertical alignment with the slots of the upper block. In this manner, the blocks 11 may be easily assembled on a foundation F in courses of longitudinal staggered rows forming a wall with a series of elongated vertical slots extending from the bottom to the top of the wall. The series of vertical slots may be used to receive structural members S, pipes P, or wiring W, and may also be used as air spaces for circulation or thermal and acoustic insulation.

Figure 8:
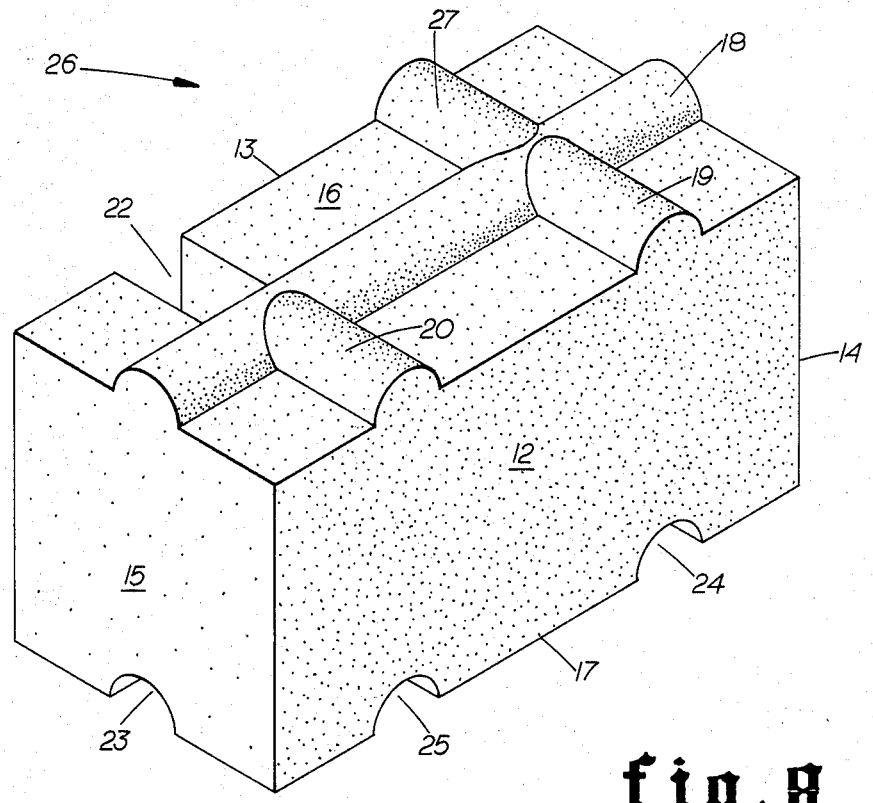
FIG. 8 is an isometric view of a preferred corner block in accordance with the present invention showing the top, one side, and one end surface of the block.
Figure 9:
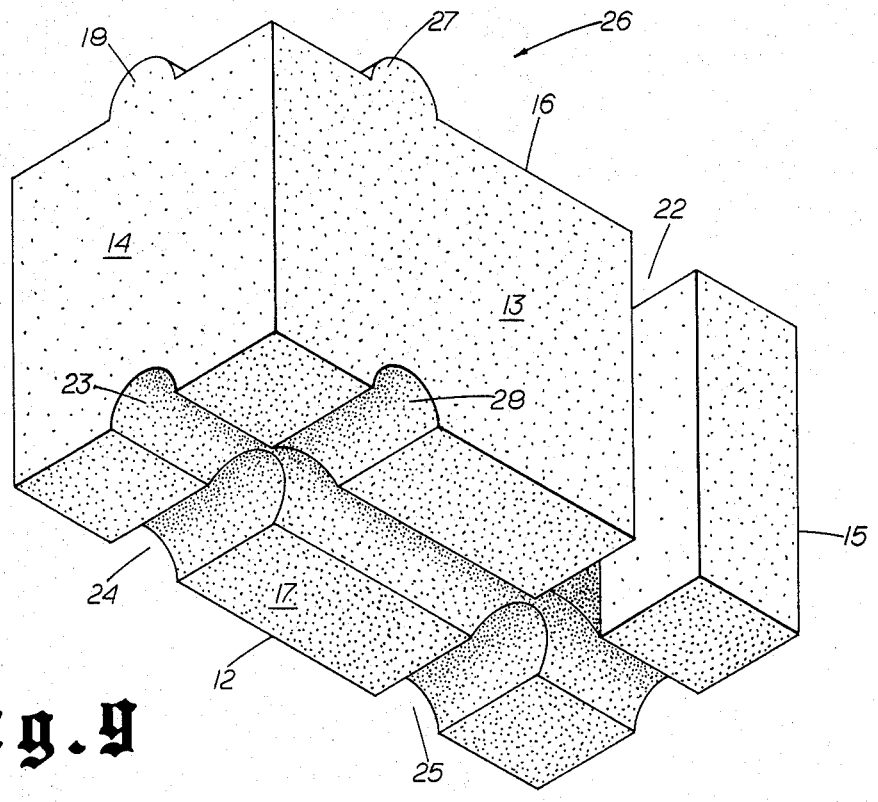
FIG. 9 is an isometric view of a preferred corner block in accordance with the present invention showing the bottom, one side, and one end surface of the block.

FIGS. 8 and 9 show a corner block 26 for use with the stretcher blocks 11 in forming corners of walls. Identical numerals refer to identical parts previously described. The corner block 26 is similar to the stretcher blocks 11 previously described except that only one vertical slot 22 (or 21) is used. The vertical slot is shown spaced from the end wall 15, however the slot could be spaced from the other end wall 14 for use at the opposing corner of the wall. The corner block 26 includes the pair of transverse, longitudinally spaced arcuate ribs 19 and 20 on the upper face 16 of the block and is has a third transverse rib 27 coextensive with 19 or 20 which is the same height as the longitudinal rib 18 and extends laterally from the rib 18 to of the longitudinal side surface 13.

The corner block 26 has the central longitudinal concave arcuate recess 23 on the lower face 17 and the pair of transverse concave arcuate recesses 24 and 25 as in the stretcher block 11. Lower face 17 has a third transverse arcuate recess 28 coextensive with recess 24 or 25 which is the same depth as the longitudinal recess 23 and extends laterally from the recess 23 to the side surface 13.

As shown in FIG. 1, the corner block may be placed in the corner position of the wall over the abutting halves of the intersection of another corner block 26 in perpendicular abutment with a stretcher block 11. It should be understood that the standard stretcher block 11 may also be used at the corners by placing it perpendicular to the end wall of the abutting block.

Figure 10:
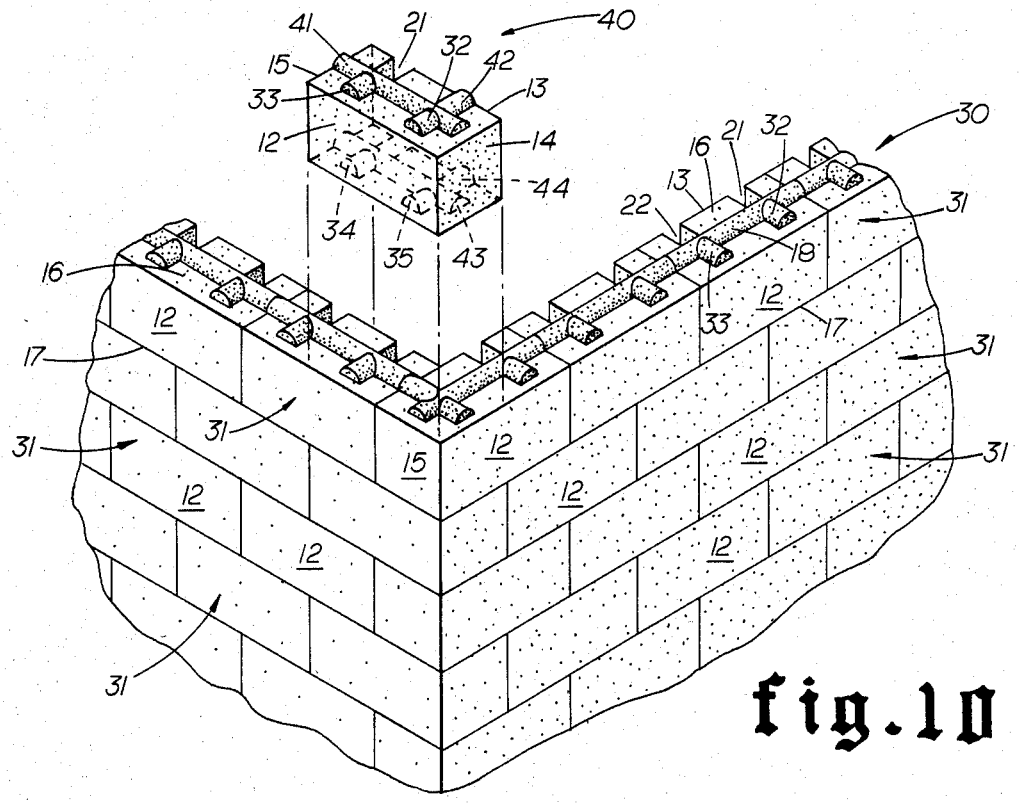
FIG. 10 is a partial isometric view of a wall, viewed from the outside, constructed using the modified building blocks of FIGS. 11–13, and a modified corner block, in accordance with the present invention.
Figure 11:
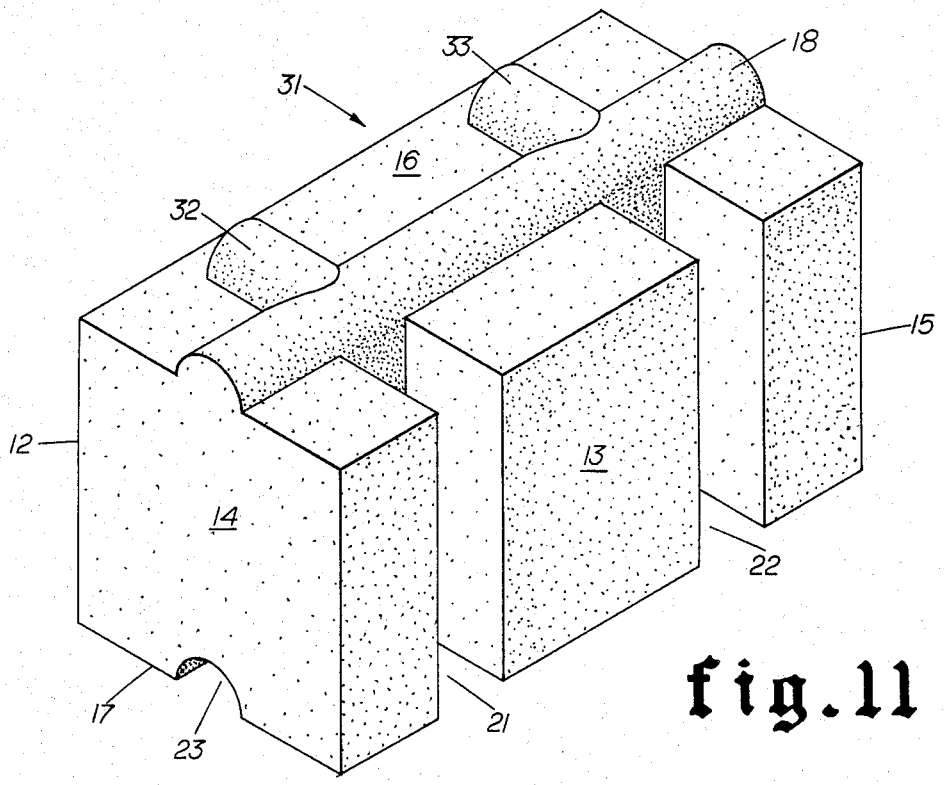
FIG. 11 is an isometric view of a modified stretcher block.
Figure 12:
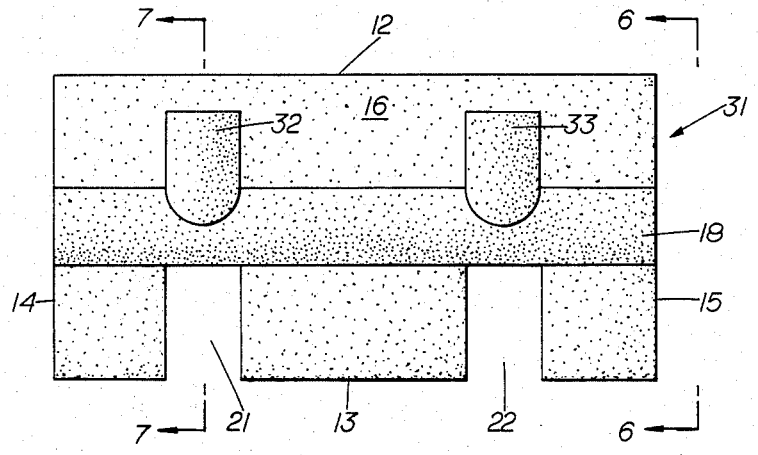
FIG. 12 is a top plan view of the modified stretcher block of FIG. 11.
Figure 13:
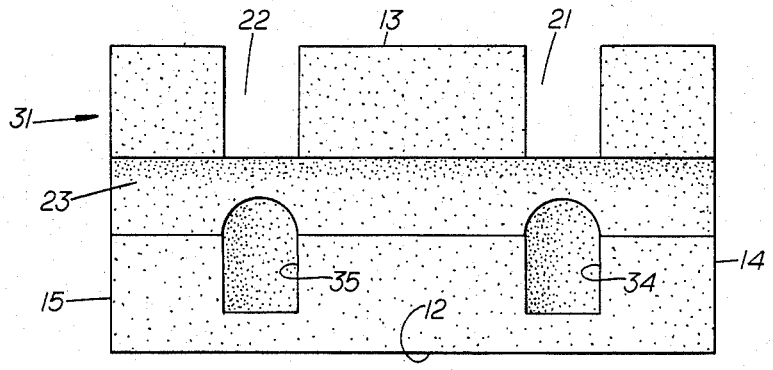
FIG. 13 is a bottom plan view of the modified stretcher block of FIG. 11.

FIG. 10 shows a wall 30 constructed with a modified stretcher block 31 and corner block 40 in which identical numerals refer to identical parts previously described. The stretcher block 31, shown in detail in FIGS. 11, 12, and 13, is similar to the stretcher block 11 previously described except that the pair of transverse arcuate ribs 32 and 33 on the upper face 16 of the block each extend laterally from the longitudinal rib 18 and terminate a distance inwardly of the side surface 12.

Figure 6:
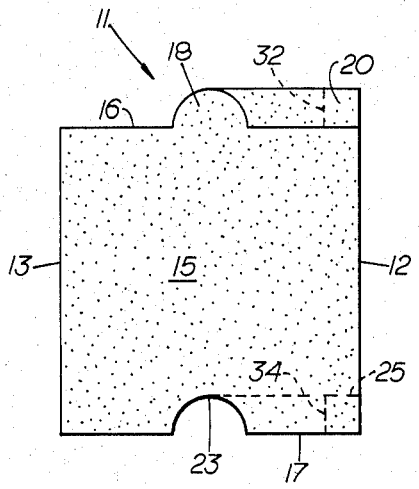
FIG. 6 is a side elevation of the stretcher block.
Figure 7:
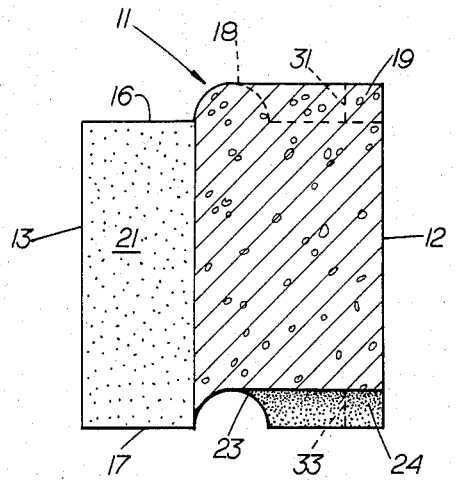
FIG. 7 is a cross section of the stretcher block taken along line 7—7 of FIG. 4.

The pair of transverse arcuate recesses 34 and 35 on the lower face 17 of the block 30 inwardly of the end walls 14 and 15 extend laterally from the longitudinal recess 23 and terminate a distance from the longitudinal side surface 12. The longitudinal and transverse recesses are spaced and of sufficient size to receive the longitudinal and transverse ribs of similar blocks when a wall is constructed therefrom. These modifications are illustrated in FIGS. 6 and 7 by dotted line. The pair of longitudinally spaced, vertical slots 21 and 22 formed in the block 30 are the same as in the blocks 11 previously described.

A corner block 40 for use with the stretcher blocks 31 in forming corners of wall 30 is shown in FIG. 10. The corner block 40 is similar to the blocks 11 and 26 described previously, and identical numerals refer to identical parts. A longitudinal arcuate rib 41 on the longitudinal upper face 16 of the block 11 extends centrally between the side surfaces 12 and 13, and terminates a distance inwardly from the end wall 14 (or 15). The corner block 40 has a pair of transverse arcuate ribs 32 and 33 on its upper face 16 which terminate a distance inwardly of the side surface 12 and a third transverse rib 42 coextensive with rib 32 or 33 which is the same height as the longitudinal rib 41 and extends laterally from the rib 4 to the side surface 13.

The corner block 40 has a central longitudinal arcuate recess 43 on its lower face 17 centrally between the side surfaces 12 and 13 and terminating a distance inwardly from the end wall 14 (or 15). The corner block 40 has a pair of transverse arcuate recesses 34 and 35 on its lower face 17 which terminate a distance from the side surface 12 and a third transverse arcuate recess 44 coextensive with recess 34 or 35. The transverse recess 44 is the same depth as the longitudinal recess 43 and extends laterally from the recess 43 to the longitudinal side surface 13.

As shown in FIG. 10, the corner block 40 may be placed in the corner position of the wall over the abutting halves of the intersection of another corner block in perpendicular abutment with a stretcher block. It should be understood that the standard stretcher block 11 may also be used at the corners by placing it perpendicular to the end wall of the abutting block.

Referring again to FIG. 1, walls constructed with blocks according to the present invention may be assembled by unskilled labor and may or may not utilize bonding material, mortar, or adhesive between the joints. After the wall has been erected, an exterior sheathing or finished veneer 50 may be applied to the exterior side. The appropriate wiring W, pipes P, and structural members S, may be installed in the slots, and the interior wall material 51 such as paneling, or sheet rock, etc. simply installed by conventional means to the interior surface of the blocks, or attached to the structural members.

OPERATION

The blocks forming the walls are set conventionally on a suitable foundation or footing end to end with the longer dimension of the facing surfaces horizontal to form the first course and the successive courses of blocks are laid in an offset or staggered relation to the blocks of the preceding course. Each block of the successive courses spans a joint of the preceding course.

After the wall has been constructed, a finished coating of plaster, stucco, or other suitable material may be applied to one or both sides of the wall to provide a finished appearance. An exterior sheathing or finished veneer 50 may be also be applied to the exterior side. The appropriate wiring W, pipes P, and structural members S, may be installed in the vertical slots, and the interior wall material such as paneling, or sheet rock, etc. may be easily installed by conventional means to the interior surface of the wall or attached to the structural members. The structural members S may be of any suitable bulding material, such as channel iron or steel, I-beam, H-beam, or the like, anchored in the ground and to the wall.

The resulting wall constructed with the blocks of the present invention provides an essentially monolithic structure, held together by its own weight and the system of interlocking ribs and groove, and having no bonding except as may sometimes be desired for further strengthening. Walls constructed in accordance with the invention may be used as bearing or non-bearing walls, either exterior or interior, as well as foundation walls and fence walls.

The invention eliminates the need for a bonding agent in the joints and substantially reduces the time required to construct a block wall. Construction time is also reduced by providing a plurality of vertical slots which may be used for the installation of plumbing, electrical conduit, telephone wiring and the like.

While this invention has been described fully and completely with special emphasis upon a preferred embodiment, it should be understood that within the scope of the appended claims the invention may be practiced otherwise than as specifically described herein.

I claim:

1. A wall formed of superimposed courses of rectangular building blocks, each course comprising:

a plurality of blocks positioned in end-to-end abutting relation with each course offset from the next lower course with each block in a higher course overlaying the joint between the blocks in the next lower course, each of said blocks including a pair of opposed side surfaces, a pair of opposed upper and lower faces, a pair of opposed vertical end walls transverse of said side surfaces and said upper and lower faces, said upper face having a longitudinal rib centered thereon, said upper face having a pair of transverse longitudinally spaced ribs inwardly of said end walls, said transverse ribs having the same height as said longitudinal rib and extending laterally therefrom to one of said side surfaces, said lower face having a longitudinal recess centered between said side surfaces, and said lower face having a pair of transverse longitudinally spaced recesses inwardly of said end walls, said transverse recesses being the same depth as said longitudinal and recess and extending laterally therefrom to said one side surface, said longitudinal and transverse recesses spaced and of sufficient size corresponding to said longitudinal and transverse ribs to receive the longitudinal and transverse ribs of similar blocks when a wall is constructed therefrom, the spacing of said transverse recesses being symmetrical about the central vertical axis of said block whereby each block in a higher course rests on the intersection of two abutting blocks in the next lower course with one transverse rib from each lower block received in each transverse recess of said upper block, a pair of longitudinally spaced vertical slots formed in each said block inwardly of said end walls and extending vertically therethrough, said slots extending inwardly from the other of said side surfaces aligned with said transverse ribs to a depth terminating tangentially at said longitudinal rib, and the spacing of said slots being symmetrically spaced about the central vertical axis of said block and aligned with said transverse ribs whereby said blocks in the respective courses have their slots in vertical alignment with the slots in the blocks in the courses above and below.

2. A wall formed of superposed courses of rectangular building blocks according to claim 1 in which said wall intersects another wall at a right angle corner and the corner blocks each further include:

a third transverse rib of the same height as said longitudinal rib aligned with and extending from one of said pair of transverse longitudinally spaced ribs on said upper face to the other of said side surfaces, and said lower face having a third transverse recess in opposed axial alignment and coextensive with one of said pair of transverse recesses of the same depth as said longitudinal recess and extending laterally thereform to the other of said side surfaces, the spacing of said ribs and recesses symmetrical about the central vertical axis of said block whereby one block may be placed over the intersection of perpendicular abutting halves of similar blocks with one transverse rib from each lower block received in each transverse recess of the upper block and one vertical slot from each lower block in vertical alignment with the slot of the upper block.

3. A wall formed of superposed courses of rectangular building blocks according to claim 1 in which said pair of transverse ribs formed on said upper longitudinal face inwardly of said end walls extend laterally from said longitudinal rib and terminate a distance from said one longitudinal side surface and aligned with said vertical slots.

4. A wall formed of superposed courses of rectangular building blocks according to claim 1 in which each of said blocks has a length twice its width, said pair of transverse ribs being positioned respectively at positions one-fourth and three fourths of the length of said upper face of said block, said pair of transverse recesses being positioned respectively at positions one-fourth and three fourths of the length of said lower face of said block and being the same depth as said longitudinal recess and extending laterally therefrom to said one side surface, and said spacing of said transverse recesses and ribs locating each block in a higher course on the intersection of two abutting blocks in the next lower course with one transverse rib from each lower block received in each transverse recess of said upper block.

5. A wall formed of superposed courses of rectangular building blocks according to claim 1 in which each of said blocks has a length twice its width, said pair of longitudinally spaced vertical slots being positioned respectively at positions one-fourth and three fourths of the length of said other side face of said block, and the spacing of said slots being effective to position the slots in the blocks of one course in vertical alignment with the slots in the blocks in the courses above and below.

6. A rectangular building block having a pair of opposed side surfaces, a pair of opposed upper and lower faces, a pair of opposed vertical end walls transverse of said side surfaces and said upper and lower faces, said upper face having a longitudinal ribe centered thereon, said upper face having a pair of transverse longitudinally spaced ribs inwardly of said end walls, said transverse ribs having the same height as said longitudinal rib and extending laterally therefrom to one of said side surfaces, said lower face having a longitudinal recess centered between said side surfaces, and said lower face having a pair of transverse longitudinally spaced recesses inwardly of said end walls, said transverse recesses being the same depth as said longitudinal recess and extending laterally therefrom to said one side surface, said longitudinal and transverse recesses spaced and of sufficient size corresponding to said longitudinal and transverse ribs to receive the longitudinal and transverse ribs of similar blocks when a wall is constructed therefrom, the spacing of said transverse recesses symmetrical about the central vertical axis of said block whereby one block may be placed over the intersection of two abutting blocks with one transverse rib from each lower block received in each transverse recess of the upper block in constructing a wall therefrom, a pair of longitudinally spaced vertical slots formed in each said block inwardly of said end walls and extending vertically therethrough, said slots extending inwardly from the other of said side surfaces aligned with said transverse ribs to a depth terminating tangentially at said longitudinal rib, and the spacing of said slots being symmetrical about the central vertical axis of said lock and aligned with said transverse ribs whereby said blocks may be stacked in courses with one block positioned over the intersection of two abutting blocks with one transverse rib from each lower block received in each transverse recess of the upper block and one vertical slot from each lower block in vertical alignment with the slots of the upper block.

7. A rectangular building block according to claim 6 in which said slots have parallel side walls.

8. A rectangular building block according to claim 6 further comprising a third transverse rib of the same height as said longitudinal rib aligned with and extending from one of said pair of transverse longitudinally spaced ribs on said upper face to to the other of said side surfaces, and said lower face having a third transverse recess in opposed axial alignment and coextensive with one of said pair of transverse recesses of the same depth as said longitudinal recess and extending laterally therefrom to the other of said side surfaces, the spacing of said ribs and recesses being symmetrical about the central vertical axis of said block whereby one block may be placed over the intersection of perpendicular abutting halves of similar blocks with one transverse rib from each lower block received in each transverse recess of the upper block and one vertical slot from each lower block in vertical alignment with the slot of the upper block.

9. A rectangular building block according to claim 6 in which said block has a length twice its width, said pair of longitudinally spaced vertical slots being positioned respectively at positions one-fourth and three fourths of the length of said other side face of said block, and the spacing of said slots being effective to position the slots in the blocks of one course in vertical alignment with the slots in the blocks in the courses above and below.

* * * * *